US007364066B1

(12) United States Patent
Wilson

(10) Patent No.: US 7,364,066 B1
(45) Date of Patent: Apr. 29, 2008

(54) MAIL BOX CONFIGURED TO PREVENT DAMAGE FROM SNOW PLOWS

(76) Inventor: Walter T. Wilson, 2049 Tacoma, Stanton, MI (US) 48888

( * ) Notice: Subject to any disclaimer, the term of this patent is extended or adjusted under 35 U.S.C. 154(b) by 0 days.

(21) Appl. No.: 11/825,532

(22) Filed: Jul. 6, 2007

(51) Int. Cl.
*A47G 29/12* (2006.01)

(52) U.S. Cl. ..... 232/17; 232/39; 248/156

(58) Field of Classification Search ..... 232/17, 232/39, 38; D99/29–32; 248/131, 146, 248/156

See application file for complete search history.

(56) References Cited

U.S. PATENT DOCUMENTS 2,025,251 A * 12/1935 Steinbronn ..... 232/34
D154,234 S * 6/1949 Batzler ..... D99/29
3,243,104 A * 3/1966 Fillion ..... 232/33
4,955,534 A 9/1990 Raible
D342,367 S * 12/1993 Lamancusa ..... D99/30
D348,554 S * 7/1994 Shapiro et al. ..... D99/31
D377,256 S * 1/1997 Parrish, Jr. ..... D99/32
5,806,758 A * 9/1998 Erwin et al. ..... 232/39
D423,756 S * 4/2000 Borer ..... D99/30
D479,382 S 9/2003 Yeager
D484,668 S * 12/2003 Morgan et al. ..... D99/29
D488,610 S * 4/2004 Coleman ..... D99/30
6,974,073 B1 * 12/2005 Snyder ..... 232/29
D516,270 S 2/2006 Mathis
7,172,163 B1 * 2/2007 Johnson ..... 248/146
D547,925 S * 7/2007 Schappler ..... D99/29
D548,925 S * 8/2007 Haberman ..... D99/30
2006/0145048 A1 * 7/2006 Robinson ..... 248/533

* cited by examiner

*Primary Examiner*—William L. Miller

(57) ABSTRACT

A mailbox has an aerodynamic shape that deflects snow thrown by the snowplow and an anchoring system that permits stable anchoring of the mailbox, yet easy replacement in the event such replacement is required.

7 Claims, 2 Drawing Sheets

MAIL BOX CONFIGURED TO PREVENT DAMAGE FROM SNOW PLOWS

TECHNICAL FIELD OF THE INVENTION

The present invention relates to the general art of mailboxes, and to the particular field of mailboxes that are resistant to external damage.

BACKGROUND OF THE INVENTION

In rural areas, it is common for mailboxes to be mounted on posts at the roadside. In many instances, a mail box may be damaged or broken off due to impact from the snow from the snowplow, and other foreign objects such as ice, dirt, stone, etc. Once a mailbox is broken off, it is often difficult and quite annoying to replace it. Because most mailboxes are mounted on support posts that are, in turn, mounted in concrete, once a mailbox is broken, part of the support post remains in the ground firmly embedded in the concrete. This creates a problem for any replacement mailbox. The concrete block must be removed and replaced or the new mailbox must be located at a location that is spaced apart from the old mailbox. Neither of these solutions is entirely satisfactory. Therefore, there is a need for a mailbox that can be easily replaced if damaged, yet will be securely anchored when it is in place.

SUMMARY OF THE INVENTION

The above-discussed disadvantages of the prior art are overcome by a mailbox that has an aerodynamic shape that resists impact from the snow thrown by the snowplow and an anchoring system that permits stable anchoring of the mailbox, yet easy replacement in the event such replacement is required.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
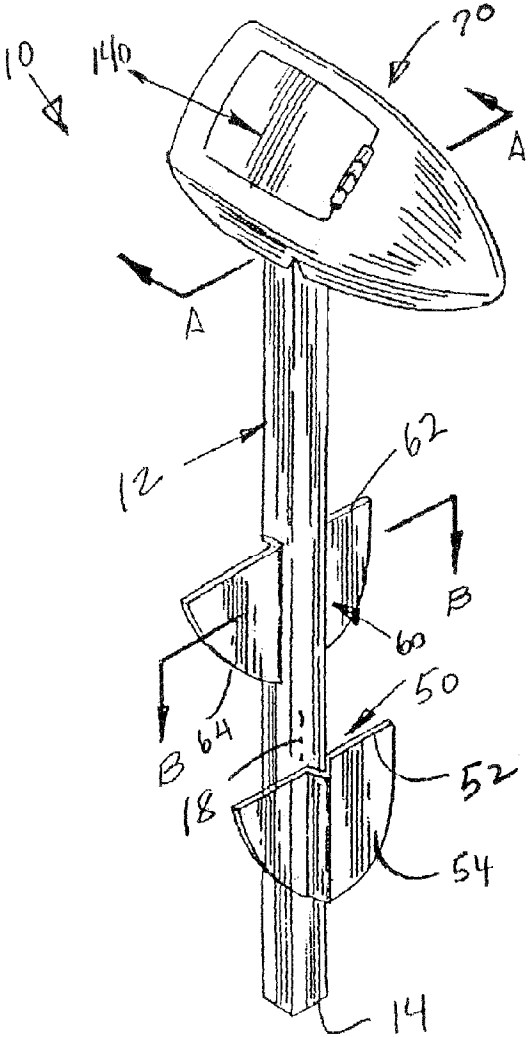
FIG. 1 is a perspective view of a mailbox embodying the present invention.
Figure 2:
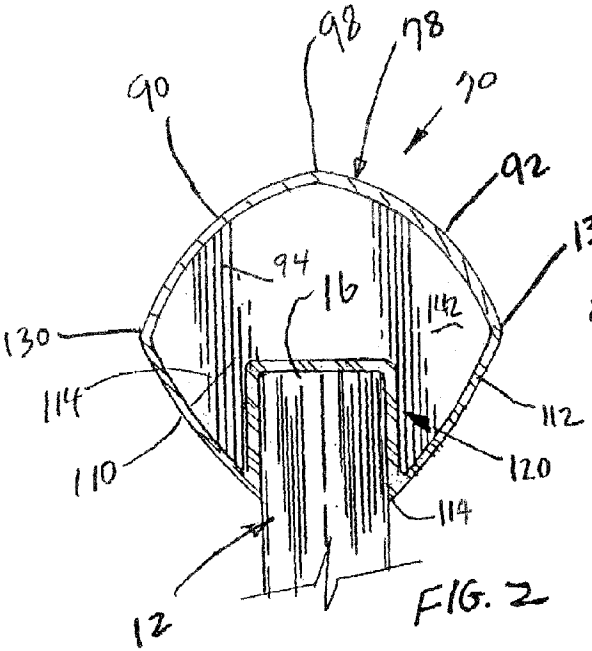
FIG. 2 is a sectional view taken along line A-A of FIG. 1.
Figure 3:
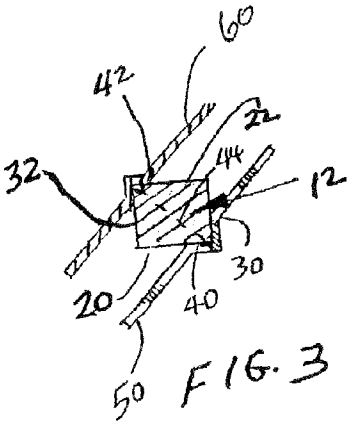
FIG. 3 is a sectional view taken along line B-B of FIG. 1.
Figure 4:
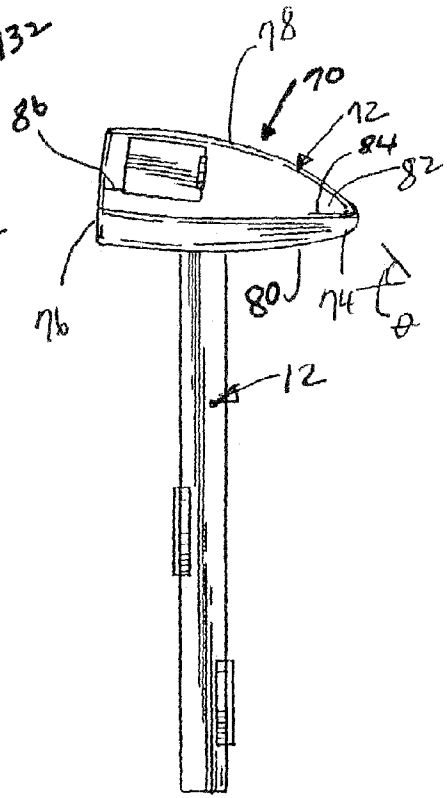
FIG. 4 is a side elevational view of the mailbox shown in FIG. 1.

Referring to the figures, it can be understood that the present invention is embodied in a mailbox unit 10 which resists damage due to snow, ice and the like and, if damaged is easily replaced. Mailbox unit 10 comprises a support post 12 which has a first end 14 which is a bottom end when the post is in use, a second end 16 which is a top end when the post is in use, and a longitudinal axis 18 which extends between first end 14 and second end 16. Support post 12 further includes a first sidewall 20, a second sidewall 22, a first endwall 30 and a second endwall 32. A first corner 40 is formed by an intersection of first sidewall 20 and first endwall 30. First corner 40 is a front corner when support post 12 is in use. A second corner 42 formed by the intersection of second endwall 32 and second sidewall 22. Second corner 42 is a rear corner when the support post is in use. A transverse axis 44 extends between first corner 40 and second corner 42.

A first wing 50 is mounted on the first sidewall and the second endwall at first corner 40 and is embedded in a support material, such as the ground, when the support post is mounted in the support material. First wing 50 includes a linear edge 52 which is a top edge when the support post is in use and an arcuate edge 54 which is a bottom edge when the support post is in use. A second wing 60 is mounted on the second sidewall and the second endwall at second corner 42 so support post transverse axis 44 is interposed between the first wing and the second wing. Second wing 60 is embedded in the support material when the support post is mounted in the support material. Second wing 60 is oriented to be parallel to the first wing, and is spaced apart from the first wing in the direction of support post longitudinal axis 18 toward second end 16 of the support post whereby second wing 60 is located above first wing 50 when the support post is in use. Second wing 60 includes a linear edge 62 which is a top edge when the support post is in use and an arcuate edge 64 which is a bottom edge when the support post is in use. The wings support the post in place so there is no need for a large concrete block to be placed in the ground to support the mailbox unit. If the support post becomes damaged or broken, it is far easier to replace the support post of the present mailbox unit than to replace prior art mailbox units that require a large block of concrete for support.

A mailbox 70 is mounted on second end 16 of the support post and includes an outer shell 72 which has a first end 74, a second end 76, a first surface 78 that is a top surface when the outer shell is mounted on the support post and a second surface 80 that is a bottom surface when the outer shell is mounted on the support post. The first and second surfaces form a cone 82 at the first end with the first end being an apex of the cone. The cone having a radius 84 at the first end. Second end 76 is arcuate with a radius 86 that is larger than radius 84 of the first end.

First surface 78 has two arcuate portions 90 and 92. Each portion of the first surface has a radius of curvature 94. The radius of curvature of the first portion is essentially equal to the radius of curvature of the second portion. The first and second portions of the first surface intersect each other to form an arcuate top edge 98 which extends between the first and second ends of the outer shell.

Second surface 80 has two arcuate portions 110 and 112 each of which has a radius of curvature 114. The radius of curvature of first portion 110 is essentially equal to the radius of curvature of second portion 112 of the second surface. The radiuses of curvature of the first and second portions of second surface 80 are larger than the radiuses of curvature of the first and second portions of first surface 78. The first and second portions of second surface 80 intersect each other to form an arcuate bottom edge 114. A post-accommodating blind-ended bore 120 is defined in second surface 80 of the outer shell at the bottom edge.

First portion 90 of first surface 78 intersects first portion 110 of second surface 80 and second portion 92 of first surface 78 intersects second portion 112 of second surface 80 to form arcuate side edges 130 and 132 that extend between the first and second ends of the outer shell. Outer shell 70 forms an aerodynamic bullet like shape. The first end 74, which is the pointed end of the mail box 70, may face the street to deflect the snow and ice thrown by the snowplow vehicle. Moreover, the bullet shaped outer shell sheds or deflects snow and ice from the snowplow so snow and ice are less likely to damage the mailbox unit than with the usual shaped mailbox. The outer shell can be oriented so the pointed end faces oncoming wind which further reduces stress on the mailbox.

A door 140 is hingeably mounted on one arcuate portion of the first surface of the outer shell. The outer shell is hollow and defines a chamber 142 which will contain mail and the like that is inserted thereinto via door 140. The outer shell is oriented so longitudinal axis of the outer shell is oriented at an oblique angle θ with respect to longitudinal axis 18 of the support post.

Figure 5:
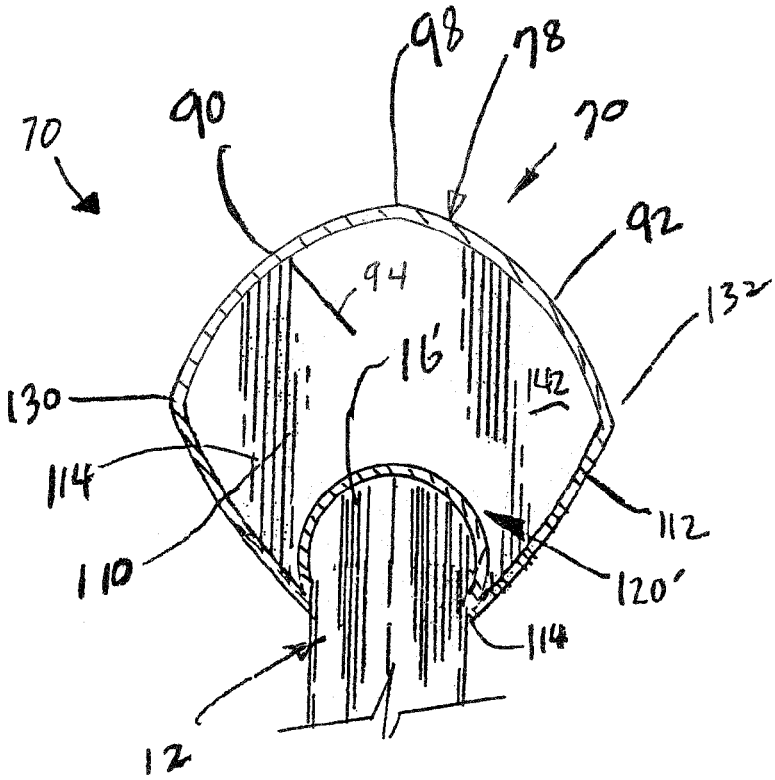
FIG. 5 is an alternative sectional view taken along line A-A of FIG. 1.

FIG. 5 shows the second end 16' of the support post 12 having a round configuration or a socket end, and the post-accommodating blind-end having a round bore 120' adapted to receive the socket end 16' to allow the mail box 70 to rotate depending on the situation. The round bore 120 may be frictionally engaged with the socket end 16' so that the mail box can not be easily rotated. This allows the home owner to turn the first end 74 to the desired direction such as facing down and towards the street in line with the direction of the snow being thrown by the snowplow so that the mailbox can deflect the snow.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A mailbox unit comprising:

A) a support post having
- (1) a first end which is a bottom end when the post is in use,
- (2) a second end which is a top end when the post is in use, (3) a longitudinal axis which extends between the first end and the second end,
- (4) a first sidewall,
- (5) a second sidewall,
- (6) a first endwall,
- (7) a second endwall,
- (8) a first corner formed by an intersection of the first sidewall and the first endwall, the first corner being a front corner when the support post is in use,
- (9) a second corner formed by the intersection of the second endwall and the second sidewall, the second corner being a rear corner when the support post is in use, and
- (10) a transverse axis which extends between the first corner and the second corner;

B) a first wing mounted on the first sidewall and the second endwall at the first corner and which is embedded in a support material when the support post is mounted in the support material;

C) a second wing mounted on the second sidewall and the second endwall at the second corner so the support post transverse axis is interposed between the first wing and the second wing, the second wing being embedded in a support material when the support post is mounted in the support material, the second wing being oriented to be parallel to the first wing, the second wing being spaced apart from the first wing in the direction of the longitudinal axis toward the second end of the support post whereby the second wing is located above the first wing when the support post is in use; and D) a mailbox mounted on the second end of the support post and including
- (1) an outer shell which has
  - (a) a first end,
  - (b) a second end,
  - (c) a first surface that is a top surface when the outer shell is mounted on the support post,
  - (d) a second surface that is a bottom surface when the outer shell is mounted on the support post,
  - (e) the first and second surfaces forming a cone at the first end with the first end being an apex of the cone, the cone having a radius at the first end,
  - (f) the second end being arcuate with a radius that is larger than the radius of the first end,
  - (g) the first surface having two arcuate portions each of which has a radius of curvature, with the radius of curvature of the first portion being essentially equal to the radius of curvature of the second portion, the first and second portions of the first surface intersecting each other to form an arcuate top edge which extends between the first and second ends of the outer shell,
  - (h) the second surface having two arcuate portions each of which has a radius of curvature, with the radius of curvature of the first portion of the second surface being essentially equal to the radius of curvature of the second portion of the second surface, the radiuses of curvature of the first and second portions of the second surface being larger than the radiuses of curvature of the first and second portions of the first surface, the first and second portions of the second surface intersecting each other to form an arcuate bottom edge,
  - (i) the first and second surfaces intersecting each other to form arcuate side edges that extend between the first and second ends of the outer shell, and
  - (j) the outer shell forming an aerodynamic bullet shape, and
- (2) a door hingeably mounted on one of the arcuate portions of the first surface of the outer shell.

2. The mailbox unit defined in claim 1 further including a post-accommodating blind-ended bore defined in the second surface of the outer shell.

3. The mailbox unit defined in claim 1 wherein the outer shell is oriented so the longitudinal axis of the outer shell is oriented at an oblique angle with respect to the longitudinal axis of the support post.

4. The mailbox unit defined in claim 3 wherein each of the first wing and the second wing includes a linear edge which is a top edge when the support post is in use and an arcuate edge which is a bottom edge when the support post is in use.

5. A mailbox unit comprising:

A) a support post having a first end which is a bottom end when the post is in use, and a second end which is a top end when the post is in use; and B) a wing mounted on the support post in a location which will be embedded in a support material when the support post is mounted in the support material; and C) a mailbox mounted on the second end of the support post and including an outer shell which has (a) a first end, (b) a second end, (c) a first surface that is a top surface when the outer shell is mounted on the support post, (d) a second surface that is a bottom surface when the outer shell is mounted on the support post, (e) the first and second surfaces forming a cone at the first end with the first end being an apex of the cone, the cone having a radius at the first end, (f) the second end being arcuate with a radius that is larger than the radius of the first end, (g) the first surface having two arcuate portions each of which has a radius of curvature, with the radius of curvature of the first portion being essentially equal to the radius of curvature of the second portion, the first and second portions of the first surface intersecting each other to form an arcuate top edge which extends between the first and second ends of the outer shell, (h) the second surface having two arcuate portions each of which has a radius of curvature, with the radius of curvature of the first portion of the second surface being essentially equal to the radius of curvature of the second portion of the second surface, the radiuses of curvature of the first and second portions of the second surface being larger than the radiuses of curvature of the first and second portions of the first surface, the first and second portions of the second surface intersecting each other to form an arcuate bottom edge, (i) the first and second surfaces intersecting each other to form arcuate side edges that extend between the first and second ends of the outer shell, and (j) the outer shell forming an aerodynamic bullet shape.

6. The mailbox unit according to claim 5, where the bullet shaped mailbox has a door hingeably mounted thereon.

7. The mail box unit according to claim 5, where the support post has a socket end and the bullet shaped mailbox is moveably engaged with the socket end to allow the bullet shaped mailbox to be moved around the socket end.

* * * * *